US011776742B2

(12) United States Patent
Igarashi et al.

(10) Patent No.: US 11,776,742 B2
(45) Date of Patent: Oct. 3, 2023

(54) COIL COMPONENT

(71) Applicant: Murata Manufacturing Co., Ltd., Kyoto-fu (JP)

(72) Inventors: Akio Igarashi, Nagaokakyo (JP); Koji Onishi, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 17/455,675

(22) Filed: Nov. 19, 2021

(65) Prior Publication Data

US 2022/0084748 A1 Mar. 17, 2022

Related U.S. Application Data

(62) Division of application No. 16/007,942, filed on Jun. 13, 2018, now Pat. No. 11,222,747.

(30) Foreign Application Priority Data

Jun. 24, 2017 (JP) ..... 2017-123775

(51) Int. Cl.
*H01F 41/10* (2006.01)
*H01F 27/28* (2006.01)
(Continued)

(52) U.S. Cl.
CPC ..... *H01F 41/10* (2013.01); *H01F 17/04* (2013.01); *H01F 27/2823* (2013.01);
(Continued)

(58) Field of Classification Search
CPC ..... H01F 41/10; H01F 27/2823; H01F 27/29; H01F 27/32
See application file for complete search history.

(56) References Cited

U.S. PATENT DOCUMENTS

2006/0267719 A1* 11/2006 Yasuda ..... H01F 17/045 336/223
2008/0003865 A1* 1/2008 Hatakeyama ..... H01F 17/045 439/399
(Continued)

FOREIGN PATENT DOCUMENTS

JP 2006121013 A 5/2006
JP 3909834 B2 4/2007
(Continued)

OTHER PUBLICATIONS

An Office Action; "Notification of Reasons for Refusal," Mailed by the Japanese Patent Office dated Sep. 3, 2019, which corresponds to Japanese Patent Application No. 2017-123775 and is related to U.S. Appl. No. 16/007,942; with English language translation.
(Continued)

*Primary Examiner* — Marlon T Fletcher
*Assistant Examiner* — Malcolm Barnes
(74) *Attorney, Agent, or Firm* — Studebaker & Brackett PC

(57) ABSTRACT

A connection section of a terminal electrode includes a reference surface, and an end portion of a wire and the connection section of the terminal electrode are connected to each other via a weld lump rising from the reference surface. A cover section to regulate an upper limit of the rise of the wire from the reference surface is provided in the terminal electrode. The cover section is so positioned as to cover at least part of the wire when viewed in a direction perpendicular to a direction in which the reference surface extends.

18 Claims, 7 Drawing Sheets

(51) Int. Cl.
*H01F 27/29* (2006.01)
*H01F 27/32* (2006.01)
*H01F 17/04* (2006.01)

(52) U.S. Cl.
CPC ..... *H01F 27/2828* (2013.01); *H01F 27/29* (2013.01); *H01F 27/292* (2013.01); *H01F 27/32* (2013.01)

(56) References Cited

U.S. PATENT DOCUMENTS

| | | | | |
|---|---|---|---|---|
| 2008/0290975 | A1* | 11/2008 | Watanabe | H01F 17/045 336/90 |
| 2013/0048616 | A1* | 2/2013 | Morimoto | B23K 1/0056 219/121.64 |
| 2015/0042436 | A1* | 2/2015 | Arimitsu | H01F 27/292 336/192 |
| 2015/0162126 | A1* | 6/2015 | Kanbe | H01F 27/2823 29/605 |
| 2016/0365191 | A1* | 12/2016 | Horie | H01F 27/292 |
| 2017/0025212 | A1* | 1/2017 | Jerez | H01F 41/0206 |
| 2017/0288626 | A1* | 10/2017 | Kobayashi | H01F 27/006 |
| 2017/0301455 | A1* | 10/2017 | Kobayashi | H01F 27/2823 |
| 2018/0182534 | A1* | 6/2018 | Horie | H01F 27/292 |
| 2018/0211756 | A1* | 7/2018 | Kuo | H01F 27/29 |
| 2018/0330869 | A1* | 11/2018 | Kim | H01F 27/2823 |
| 2019/0148063 | A1* | 5/2019 | Kim | H01F 27/34 361/56 |

FOREIGN PATENT DOCUMENTS

| | | | |
|---|---|---|---|
| JP | 2008-010753 | A | 1/2008 |
| JP | 2008-288320 | A | 11/2008 |
| JP | 2010-165862 | A | 7/2010 |
| JP | 2017-005079 | A | 1/2017 |
| TW | 201719694 | A | 6/2017 |

OTHER PUBLICATIONS

An Office Action issued by the China National Intellectual Property Administration dated Sep. 2, 2020, which corresponds to Chinese Patent Application No. 201810637685.9 and is related to U.S. Appl. No. 16/007,942 with English language translation.

An Office Action; "Notice of Reasons for Refusal," mailed by the Japanese Patent Office dated Oct. 27, 2020, which corresponds to Japanese Patent Application No. 2020-012074 and is related to U.S. Appl. No. 16/007,942 with English language translation.

* cited by examiner

COIL COMPONENT

CROSS-REFERENCE TO RELATED APPLICATION

This application is a Divisional of U.S. patent application Ser. No. 16/007,942, filed Jun. 13, 2018, and claims benefit of priority to Japanese Patent Application No. 2017-123775, filed Jun. 24, 2017, the entire content of each are incorporated herein by reference.

BACKGROUND

Technical Field

The present disclosure relates to coil components, and particularly relates to a coil component including a wire and a terminal electrode to which the wire is electrically connected.

Background Art

An interesting technique related to the present disclosure is disclosed in Japanese Patent No. 3909834, for example. In Japanese Patent No. 3909834, a wire-wound coil component including a wire and a terminal electrode to which the wire is electrically connected is described.

FIGS. 8 and 9 are taken from Japanese Patent No. 3909834, and correspond to FIG. 1B and FIG. 1C in Japanese Patent No. 3909834, respectively. In FIGS. 8 and 9, one of collar sections 71, which is part of a coil to be included in the coil component, a terminal electrode 72 disposed on the collar section 71, and an end portion of a wire 73 to be connected to the terminal electrode 72 are illustrated.

The terminal electrode 72 includes: a base section 74 disposed along an end surface on an outer side of the collar section 71; a reception section 75 that extends from the base section 74, via a bend, along an upper surface of the collar section 71 illustrated in the drawing, and receives the end portion of the wire 73; and a folding back piece 76 extending from the reception section 75, via a bend, along an end surface on an inner side of the collar section 71. As illustrated in FIG. 8, the terminal electrode 72 further includes a welding piece 78 that extends from a side edge of the reception section 75 via a bending section 77 and is welded to the wire 73, and a temporarily-fixing section 79 for temporarily fixing the wire 73 at the time of welding.

As for the welding piece 78, a state thereof before welding processing being carried out is illustrated in FIG. 8, and a state thereof after the welding processing is illustrated in FIG. 9. In FIG. 9, a weld lump 80 generated by the welding is illustrated. A metal melted during the welding is cooled and solidified, thereby producing the weld lump 80.

Details of the welding processing are as follows. Before the welding processing being carried out, as illustrated in FIG. 8, the wire 73 is inserted between the reception section 75 and the welding piece 78 as well as between the reception section 75 and the temporarily-fixing section 79. Subsequently, in order to temporarily fix the wire 73 in this state, crimping processing is carried out using a tool on the temporarily-fixing section 79 so that the wire 73 is pinched between the reception section 75 and the temporarily-fixing section 79.

Next, the wire 73 and the welding piece 78 are welded. To be more specific, laser welding is applied. A laser beam is radiated onto the welding piece 78, whereby the wire 73 and the welding piece 78 are melted together. As a result, the weld lump 80 is formed as discussed above.

SUMMARY

With the miniaturization of electronic circuits, coil components used in the circuits need to be smaller in size. To address the above issue, it has been required to make wires used in a wire-wound coil component be thinner.

In the coil component described in Japanese Patent No. 3909834, the wire 73 is temporarily fixed by carrying out crimping processing on the temporarily-fixing section 79 using a metal tool, as discussed above. When a melting portion to be the weld lump 80 is formed during the welding processing, the wire 73 tends to rise from the reception section 75 due to residual tension. However, the temporarily-fixing section 79 also has a function to prevent the wire 73 from rising from the reception section 75. Accordingly, the wire 73 can be positioned along the reception section 75 and in close proximity thereto after the welding.

However, the following problems are likely to occur as the wire 73 becomes thinner.

Problem 1: the wire 73 may be cut with an edge portion of the temporarily-fixing section 79 of the terminal electrode 72, the temporarily-fixing section 79 being a target of the crimping processing.

Problem 2: Due to a spring back of the terminal electrode 72 generated after the crimping processing, the temporarily-fixing section 79 may be opened relative to the reception section 75, thereby making it difficult to temporarily fix the wire 73 in an adequate manner.

It is to be noted that Problem 2 is likely to occur when the crimping processing is carried out with a weak force to alleviate Problem 1; conversely, Problem 1 is likely to occur when the crimping processing is carried out with a strong force to alleviate Problem 2. That is to say, it is needed to control phenomena contradictory to each other. Accordingly, as the wire 73 becomes thinner, a permissible range in which the crimping processing can be carried out becomes narrower so that the processing becomes difficult to be carried out.

Accordingly, the present disclosure provides a coil component capable of solving the above-described problems.

A coil component according to one embodiment of the present disclosure includes a wire and a terminal electrode including a connection section to which an end portion of the wire is electrically connected. The connection section of the terminal electrode includes a reference surface, and the end portion of the wire and the connection section of the terminal electrode are connected to each other via a weld lump rising from the reference surface.

The coil component further includes a cover section to regulate an upper limit of the rise of the wire from the reference surface, and the cover section is so positioned as to cover at least part of the wire when viewed in a direction perpendicular to a direction in which the reference surface extends. Note that the cover section is not a target of the crimping processing that may cause the above-mentioned problems.

It is preferable that part of the wire covered by the cover section has a substantially circular cross section. This configuration makes it possible to reduce a risk of cutting the wire or the like because the wire is not crushed by the crimping processing or the like.

It is also preferable that part of the wire covered by the cover section is not fixed. This configuration makes it possible to favorably absorb stress applied to the wire due to a thermal shock, an external force, or the like that is applied during the manufacture of the coil component or after the mount of the coil component, thereby making it possible to reduce a risk of cutting the wire or the like.

It is preferable that the cover section opposes the wire at only one surface thereof. This configuration makes it possible for the cover section to have a simple shape and also for the cover section to be formed by a simple processing method because the cover section need not be a target of the crimping processing.

When viewed in a direction parallel to the direction in which the reference surface extends, it is preferable that a distance H1 from the reference surface to a peak of the weld lump and a distance H2 from the reference surface to the cover section satisfy a relation of H2<H1, and that the distance H2 be larger than a diameter of the wire.

This configuration makes it possible to smoothly guide the wire to a position between the cover section and the reference surface in such a manner as to generate a state in which the upper limit of the rise from the reference surface can be regulated. The wire generally includes a linear center conductor and an insulation coating layer covering the circumference of the center conductor. In this case, the diameter of the wire refers to a diameter of the wire at a part thereof covered by the cover section. In other words, the diameter of the wire refers to a diameter of the center conductor and the insulation coating layer when the wire includes the insulation coating layer at the part covered by the cover section, or refers to the diameter of only the center conductor when the wire does not include the insulation coating layer at the part covered by the cover section.

In the above configuration, the wire may make contact with the cover section. Further, there may be a case in which the wire does not make contact with the reference surface, and there may be a case in which the wire makes contact with neither the cover section nor the reference surface.

It is preferable that the cover section is provided as part of the terminal electrode in a portion other than the connection section. The cover section, provided as part of the terminal electrode, can be achieved only by modifying part of the shape of the terminal electrode.

In the above preferred embodiment, it is more preferable that the terminal electrode include an upright section extending from an end edge of the connection section in a direction substantially perpendicular to the direction in which the reference surface extends, and that the cover section be provided on the upright section. Providing the cover section on the upright section makes it easy to dispose the cover section in a position where the wire is covered.

In the above configuration, it is preferable for the cover section to extend from the upright section without being bent. With this configuration, the cover section need not be a target of the crimping processing, which makes it possible to form the cover section with a simple processing method.

In the above preferred embodiments, the cover section may not overlap with the connection section when viewed in a direction perpendicular to the direction in which the reference surface extends. This configuration also makes it possible for the cover section to function in such a manner as to regulate the upper limit of the rise of the wire from the reference surface.

The coil component according to the embodiment may further include a core having a core section around which the wire is helically wound, and also having first and second collar sections respectively provided on first and second end portions on the opposite sides to each other of the core section. In this case, terminal electrodes are attached to the first and second collar sections respectively.

Like the technique described in Japanese Patent No. 3909834 mentioned above, a structure in which the wire is temporarily fixed by crimping the temporarily-fixing section needs fine bending work in a manufacture process carried out with the terminal electrode being mounted on the core. Because of this, the processing thereof is difficult to be carried out, and there also exists a risk that the terminal electrode is separated from the core in the worst case. In contrast, in the embodiment of the present disclosure, because any portion of the terminal electrode is not a target of the crimping processing, such a problem can be prevented from occurring that brings about complicated processing, causes the terminal electrode to be separated from the core, or the like, due to the crimping processing.

In the above embodiment, in the case where the wire includes first and second wires; the terminal electrode includes first and second terminal electrodes to which first and second end portions on the opposite sides to each other of the first wire are respectively connected, and also includes third and fourth terminal electrodes to which first and second end portions on the opposite sides to each other of the second wire are respectively connected. The first and third terminal electrodes are attached to the first collar section, and the second and fourth terminal electrodes are attached to the second collar section; and the first and fourth terminal electrodes are respectively positioned on the opposite sides to extended portion sides of the first and second wires from the core section, and the second and third terminal electrodes are respectively positioned on the extended portion sides of the first and second wires from the core section, it is sufficient that the cover sections are provided being associated with at least the first and fourth terminal electrodes. This is because the rise from the reference surface, which must be suppressed by the cover section, is generated only at the end portion of each of the wires connected to the first and fourth terminal electrodes.

It is preferable for the coil component according to the above embodiment to constitute a common mode choke coil. In this case, the first and second wires are wound together in the same direction around the core section.

According to the embodiments of the present disclosure, the wire is prevented from being cut due to crimping processing because the crimping processing is not carried out on the cover section.

In addition, according to the embodiments of the present disclosure, the cover section regulates the upper limit of the rise of the wire from the reference surface in the connection section of the terminal electrode, thereby making it possible for the wire welded to the connection section of the terminal electrode to be positioned along the reference surface and in close proximity thereto. Because of this, the wire is unlikely to be cut even if an external force is applied to the wire. Alternatively, in a case where the coil component is coated with a resin for moisture prevention, for example, the wire is also unlikely to be cut even if the resin enters between the reference surface and the wire in the connection section of the terminal electrode and the stated resin repeats expansion and contraction.

As has been discussed thus far, the embodiments of the present disclosure can satisfactorily meet the requirement for making the wire be thinner, which consequently makes it possible to miniaturize the coil component.

Other features, elements, characteristics and advantages of the present disclosure will become more apparent from the following detailed description with reference to the attached drawings.

DETAILED DESCRIPTION

Figure 1:
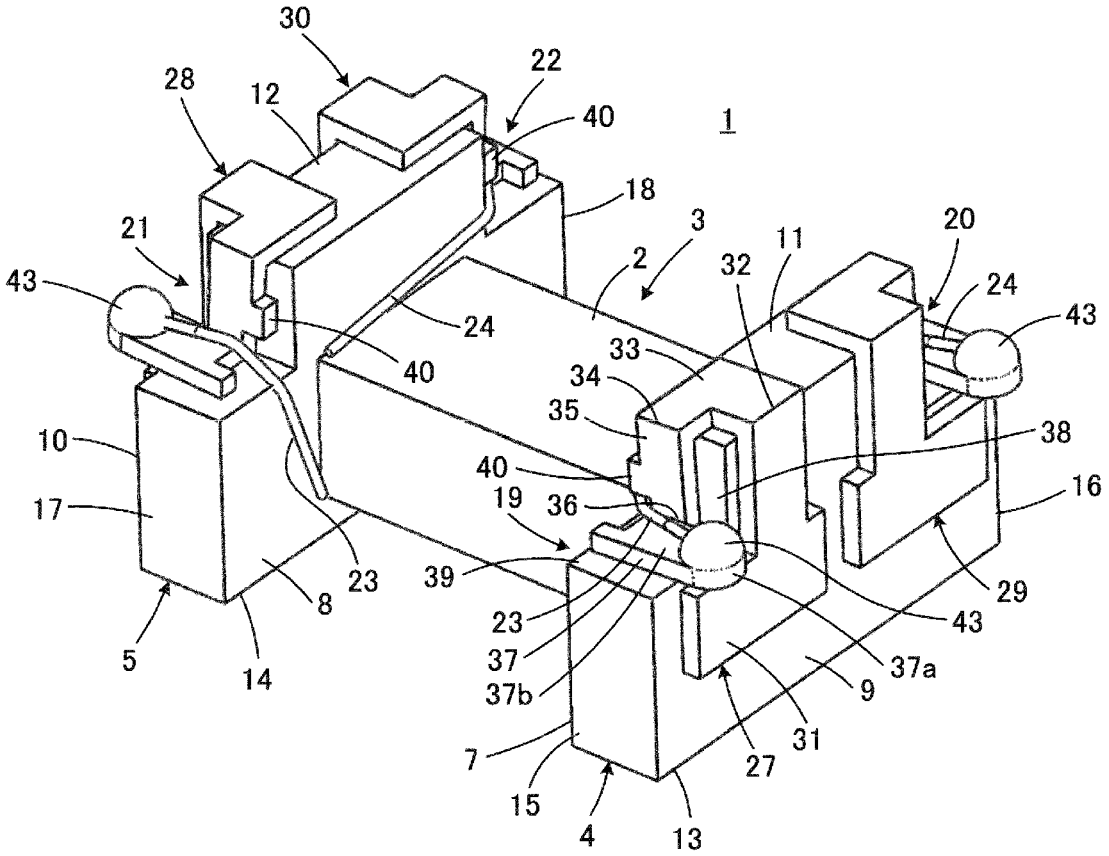
FIG. 1 is a perspective view illustrating an external appearance of a common mode choke coil as a coil component according to a first embodiment of the present disclosure when seen from a mounting surface side.

In the following description of a coil component according to an embodiment of the present disclosure, a common mode choke coil is cited as an example of the coil component. Mainly referring to FIG. 1, a common mode choke coil 1 as a coil component according to a first embodiment of the present disclosure will be described.

The common mode choke coil 1 includes a drum-shaped core 3 having a core section 2. The drum-shaped core 3 includes a first collar section 4 and a second collar section 5 respectively provided on first and second end portions on the opposite sides to each other of the core section 2. The common mode choke coil 1 may further include a plate-shaped core (not illustrated) that is provided bridging the first and second collar sections 4 and 5. Although it is preferable for the drum-shaped core 3 and the plate-shaped core to be made of ferrite, they may be made of a material other than ferrite.

It is preferable for the Curie temperature of the drum-shaped core 3 made of ferrite to be no less than approximately 150° C. This is because an inductance value thereof can be maintained equal to or more than a constant value from a low temperature up to approximately 150° C. It is preferable for relative permeability of the drum-shaped core 3 to be no more than approximately 1500. With this configuration, it is unnecessary to use a special material or member to obtain high permeability for the constitution, the material, or the like of the drum-shaped core 3. As such, the degree of freedom in design of the drum-shaped core 3 is enhanced, so that the drum-shaped core 3 with the Curie temperature being no less than approximately 150° C., for example, can be designed with ease. According to the above-discussed configuration, the common mode choke coil 1 with favorable temperature characteristics can be provided while the inductance value thereof being maintained at high temperature. It is also preferable for the Curie temperature of the plate-shaped core (not illustrated) to be no less than approximately 150° C., and for the relative permeability thereof to be no more than approximately 1500.

The collar sections 4 and 5 respectively include inner side end surfaces 7 and 8 facing the core section 2 side and positioning the end portions of the core section 2, and outer side end surfaces 9 and 10 facing outer side portions on the opposite sides to the inner side end surfaces 7 and 8. The collar sections 4 and 5 respectively include bottom surfaces 11 and 12 facing a mounting substrate side (not illustrated) at the time of mounting, and top surfaces 13 and 14 on the opposite side to the bottom surfaces 11 and 12. The plate-shaped core (not illustrated) is jointed to the top surfaces 13 and 14 of the collar sections 4 and 5. Further, the first collar section 4 includes first and second side surfaces 15 and 16 extending in a direction in which the bottom surface 11 and the top surface 13 are linked and facing the opposite sides to each other, and the second collar section 5 includes first and second side surfaces 17 and 18 extending in a direction in which the bottom surface 12 and the top surface 14 are linked and facing the opposite sides to each other.

Recesses 19 and 20 formed in a cutout shape are provided in both end portions of the bottom surface 11 of the first collar section 4. Likewise, recesses 21 and 22 formed in a cutout shape are provided in both end portions of the bottom surface 12 of the second collar section 5.

Figure 4:
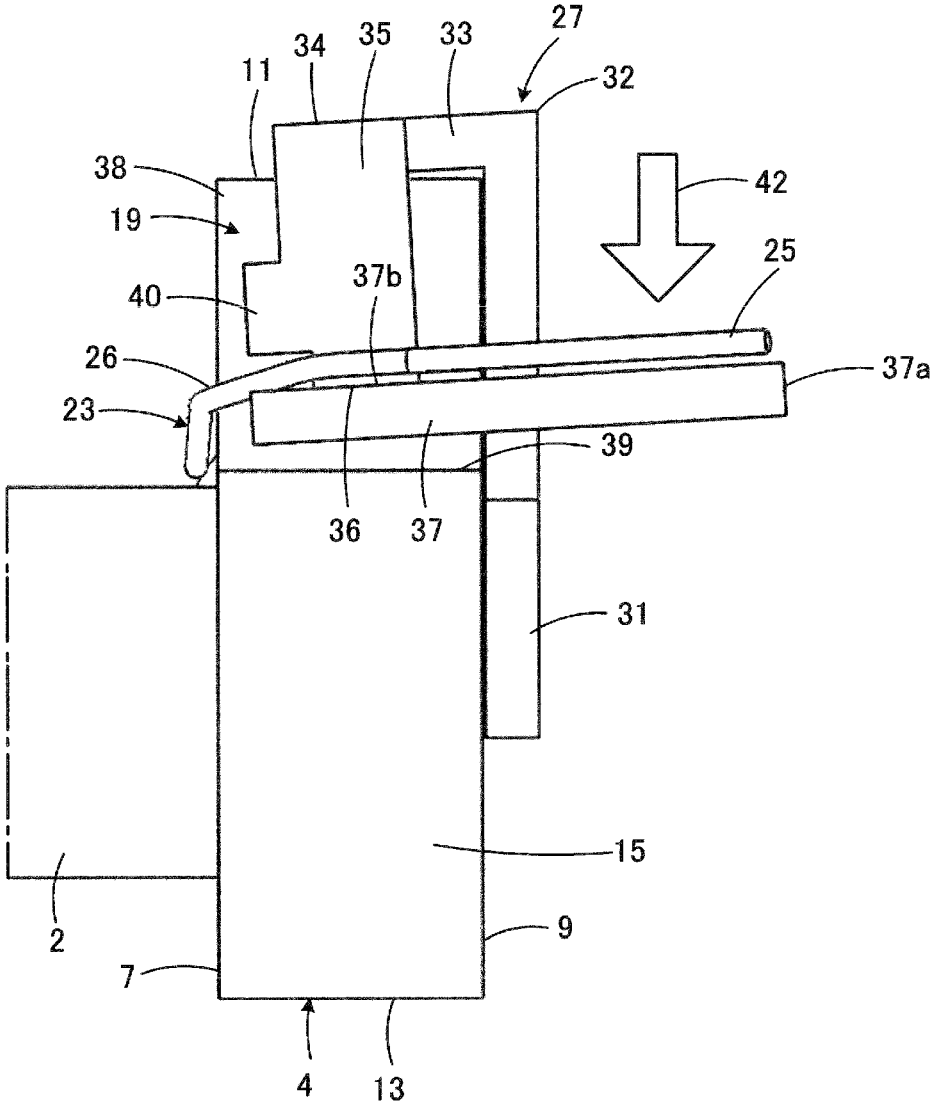
FIG. 4 is a view corresponding to FIG. 2 and illustrating a state before welding.
Figure 5:
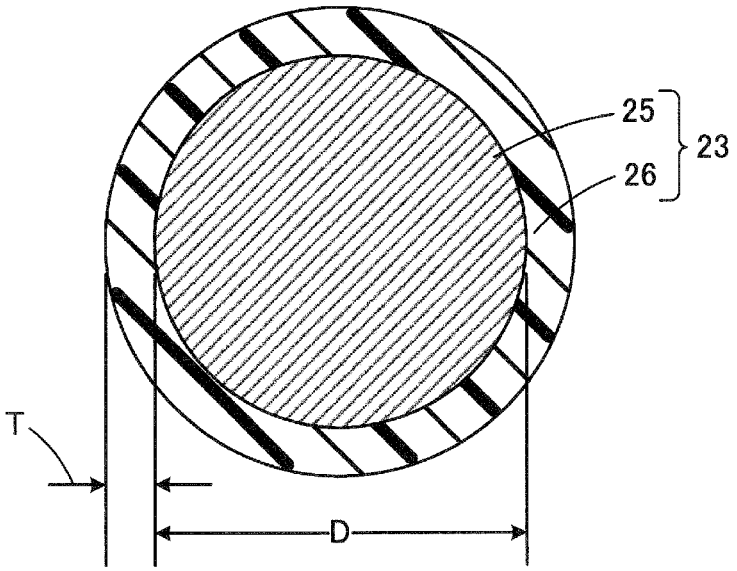
FIG. 5 is an enlarged cross-sectional view of a wire included in the common mode choke coil illustrated in FIG. 1.

The common mode choke coil 1 further includes a first wire 23 and a second wire 24 helically wound around the core section 2. In FIG. 1, only the end portions of the wires 23 and 24 are respectively illustrated, and the wires 23 and 24 around the core section 2 are not illustrated. The wires 23 and 24 around the core section 2 are also not illustrated in FIGS. 2 to 4. The wires 23 and 24 each include a linear center conductor 25 and an insulation coating layer 26 covering the circumference of the center conductor 25, as illustrated in FIG. 5. FIG. 5 illustrates the wire 23 which is one of the wires.

The center conductor 25 is formed of, for example, a copper wire. It is preferable for the insulation coating layer 26 to be formed of resin including at least imide coupling such as polyamide-imide or imide-modified polyurethane, for example. With this constitution, heat resistance that prevents decomposition even at a temperature of approximately 150° C. can be given to the insulation coating layer 26, for example. Accordingly, line capacitance does not change and Sdd11 characteristics can be made preferable, even at a high temperature like approximately 150° C. Moreover, the degree of effectiveness of excellence in noise suppression can be enhanced even at a high temperature like approximately 150° C.

The first and second wires 23 and 24 are wound in parallel to each other in the same direction. At this time, the wires 23 and 24 may be in the form of double-layer winding in which one of the wires is wound at an inner layer side while the other thereof is wound at an outer layer side, or may be in the form of bifilar winding in which the wires are alternately arranged in an axis line direction of the core section 2 and wound in a state of being aligned parallel to each other.

It is preferable for a diameter D of the center conductor 25 to be no more than approximately 35 μm. According to this configuration, since the diameters of the wires 23 and 24 can be thinned, the number of winding turns of the wires 23 and 24 around the core section 2 can be increased, miniaturization can be realized without changing the number of winding turns of the wires 23 and 24, a wire interval can be widened without changing the wires 23 and 24, the outer shape of the coil, and the like. In addition, since the ratio of the wires 23 and 24 occupying the coil outer shape is decreased, dimensions of other portions, such as the drum-shaped core 3, for example, can be made larger. This makes it possible to further improve the characteristics.

Further, it is preferable for the diameter D of the center conductor 25 to be no less than approximately 28 μm. This configuration makes the center conductor 25 unlikely to be cut.

Furthermore, it is preferable for a thickness dimension T of the insulation coating layer 26 to be no more than approximately 6 μm. With this configuration, since the diameters of the wires 23 and 24 can be thinned, the number of winding turns of the wires 23 and 24 around the core section 2 can be increased, the miniaturization can be realized without changing the number of winding turns of the wires 23 and 24, the wire interval can be widened without changing the wires 23 and 24, the outer shape of the coil, and the like. In addition, since the portion of the wires 23 and 24 occupying the coil outer shape is decreased, the dimensions of other portions, such as the drum-shaped core 3, for example, can be made larger. This makes it possible to further improve the characteristics.

It is preferable for the thickness dimension T of the insulation coating layer 26 to be no less than approximately 3 μm. With this configuration, since a distance between the center conductors 25 of the wires 23 and 24 adjacent to each other in the wound state can be made longer, the line capacitance becomes small, thereby making it possible to cause the Sdd11 characteristics to be preferable.

The common mode choke coil 1 further includes first to fourth terminal electrodes 27 to 30. Of the first to fourth terminal electrodes 27 to 30, the first and third terminal electrodes 27 and 29 are arranged in a direction in which the first and second side surfaces 15 and 16 of the first collar section 4 oppose each other, and attached to the first collar section 4 with an adhesive interposed therebetween. The second and fourth terminal electrodes 28 and 30 are arranged in a direction in which the first and second side surfaces 17 and 18 of the second collar section 5 oppose each other, and attached to the second collar section 5 with an adhesive interposed therebetween.

A first end of the first wire 23 is electrically connected to the first terminal electrode 27, and a second end on the opposite side to the first end of the first wire 23 is electrically connected to the second terminal electrode 28. Meanwhile, a first end of the second wire 24 is electrically connected to the third terminal electrode 29, and a second end on the opposite side to the first end of the second wire 24 is electrically connected to the fourth terminal electrode 30.

Figure 2:
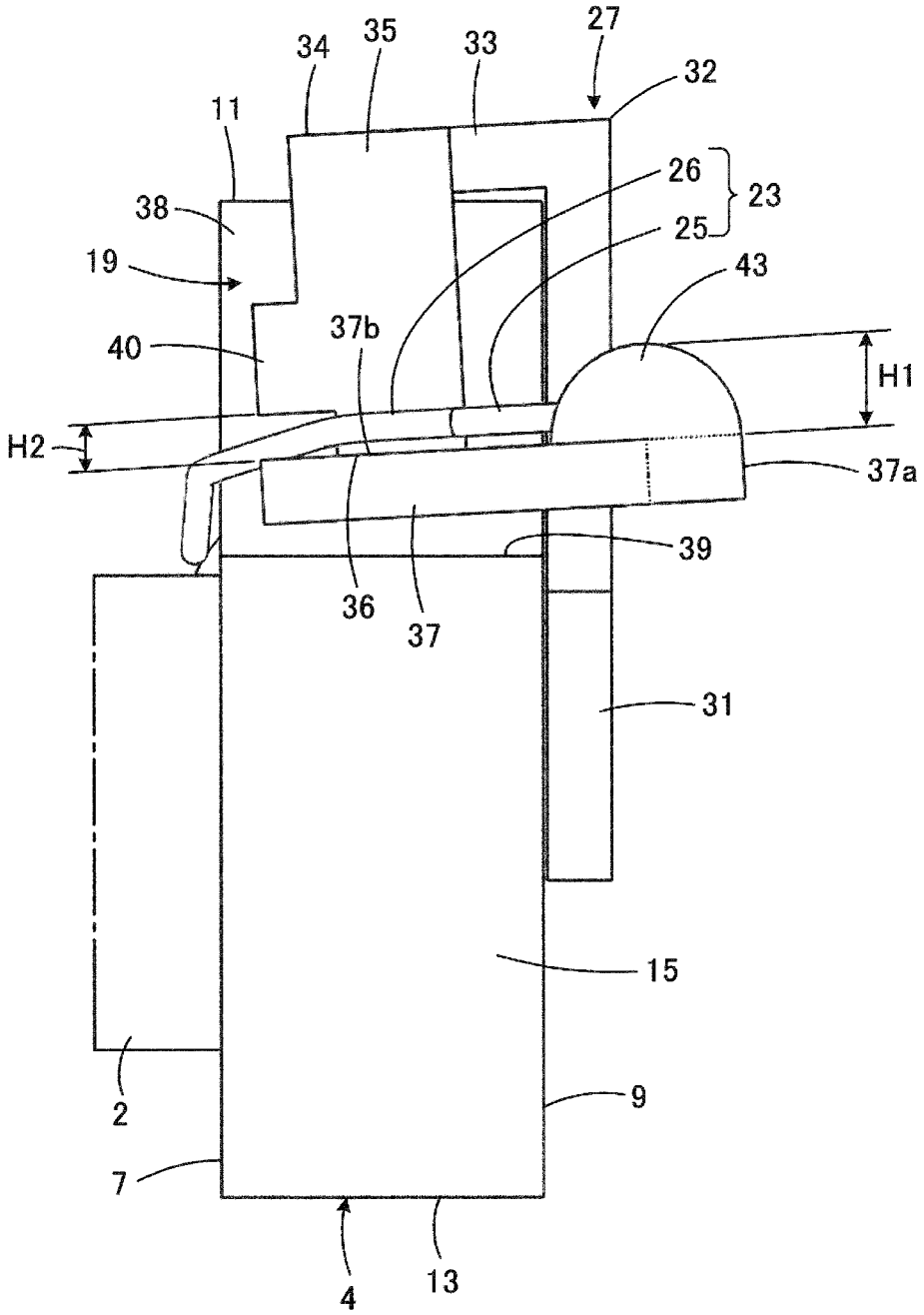
FIG. 2 is a front view where enlarged and illustrated is a configuration on a side of a first collar section, which is part of the common mode choke coil illustrated in FIG. 1 and is included in a core.
Figure 3:
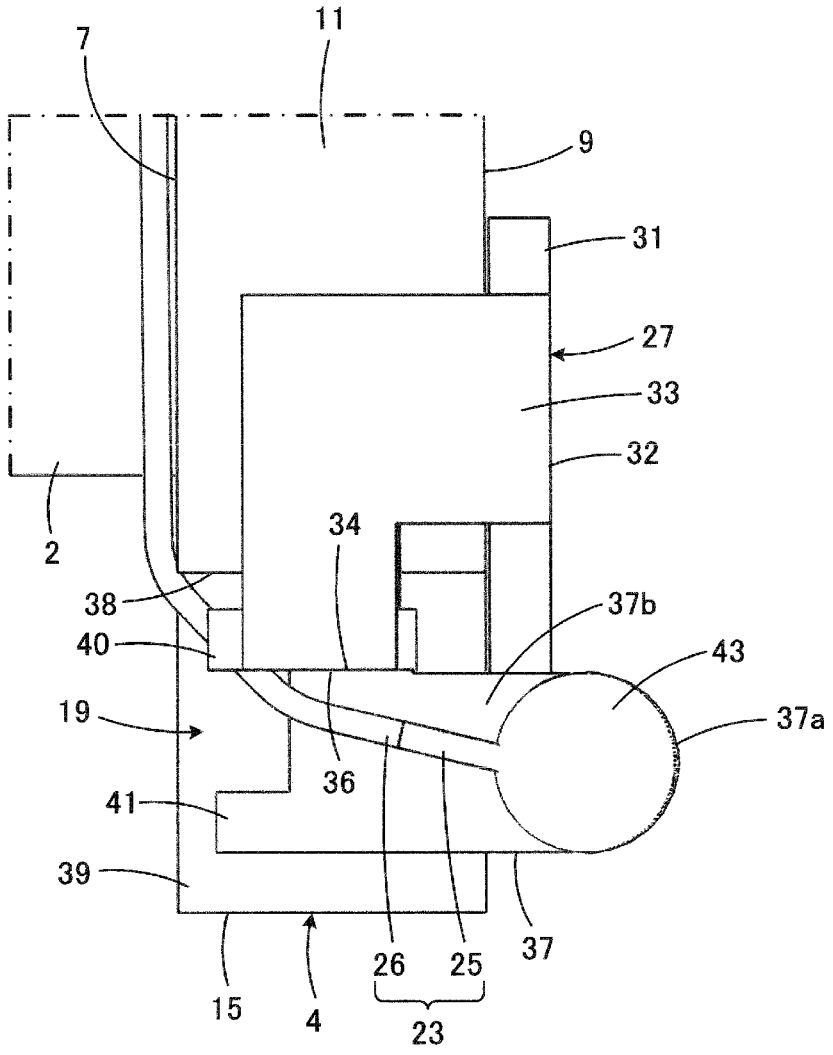
FIG. 3 is a bottom view where part of the configuration on the first collar section side illustrated in FIG. 2 is enlarged and illustrated when seen from the mounting surface side.

The first terminal electrode 27 and the fourth terminal electrode 30 are formed in the same shape, and the second terminal electrode 28 and the third terminal electrode 29 are formed in the same shape. In addition, the first terminal electrode 27 and the third terminal electrode 29 are formed in a plane-symmetrical shape, and the second terminal electrode 28 and the fourth terminal electrode 30 are also formed in a plane-symmetrical shape. Because of this, as an example of one of the first to fourth terminal electrodes 27 to 30, the first terminal electrode 27, which is most appropriately illustrated in FIG. 1 and is also illustrated in FIGS. 2 to 4, will be described in detail hereinafter while detailed description of the second to fourth terminal electrodes 28 to 30 will be omitted.

The terminal electrode 27 is typically manufactured by sequentially performing press working on a metal plate formed of a copper-based alloy such as phosphor bronze or tough pitch copper, for example. The metal plate to be a material of the terminal electrode 27 has a thickness of no more than about 0.15 mm, for example, a thickness of about 0.1 mm.

The terminal electrode 27 includes a base section 31 extending along the outer side end surface 9 of the collar section 4, and a mounting section 33 extending from the base section 31, via a first bend 32 covering a ridge line portion where the outer side end surface 9 and the bottom surface 11 of the collar section 4 intersect with each other, along the bottom surface 11 of the collar section 4. The mounting section 33 is a portion that is electrically and mechanically connected, when the common mode choke coil 1 is mounted on a mounting substrate (not illustrated), to a conductive land on the mounting substrate by soldering or the like.

The terminal electrode 27 further includes an upright section 35 extending from the mounting section 33 via a second bend 34, and a connection section 37 extending from the upright section 35 via a third bend 36. The upright section 35 extends along a vertical wall 38 regulating the recess 19, and the connection section 37 extends along a bottom wall 39 regulating the recess 19. The connection section 37 extends along the end portion of the wire 23 and also serves as a portion for electrically and mechanically connecting the wire 23 to the terminal electrode 27.

More specifically, the connection section 37 of the terminal electrode 27 includes a reference surface **37*b*. The end portion of the wire 23 and the connection section 37 are connected to each other at a leading end portion 37*a* of the connection section 37 via a weld lump 43 rising from the reference surface 37*b*. Further, a cover section 40 to regulate the upper limit of the rise of the wire 23 from the reference surface 37*b* is provided in the terminal electrode 27. The cover section 40 is provided on a portion other than the connection section 37, for example, on the upright section 35 extending from an end edge of the connection section 37 in a direction substantially perpendicular to a direction in which the reference surface 37*b* extends. In the present embodiment, the cover section 40 extends from the upright section 35 without being bent and is formed in a projection-like shape projecting from the upright section 35**.

As clearly illustrated in FIG. 3, the cover section 40 is so positioned as to cover at least part of the wire 23 when viewed in a direction perpendicular to the direction in which the reference surface **37*b* extends. Note that, however, it is sufficient that the cover section 40 can function in such a manner as to regulate the upper limit of the rise of the wire 23 from the reference surface 37*b*. Accordingly, it may be unnecessary for the cover section 40 to overlap with the connection section 37 when viewed in the direction perpendicular to the direction in which the reference surface 37*b* extends, as illustrated in FIG. 3**.

In the present embodiment, a cross section of the part of the wire 23 covered by the cover section 40 is formed in a substantially circular shape. In addition, the part of the wire 23 covered by the cover section 40 is not fixed. The cover section 40 opposes the wire 23 at only one surface thereof.

As illustrated in FIG. 2, when viewed in a direction parallel to the direction in which the reference surface 37*b* extends, it is preferable that a distance H1 from the reference surface 37*b* to a peak of the weld lump 43 and a distance H2 from the reference surface 37*b* to the cover section 40 satisfy a relation of H2<H1, and that the distance H2 be larger than the diameter of the wire 23.

This configuration makes it possible to smoothly guide the wire 23 to a position between the cover section 40 and the reference surface 37*b* in such a manner as to generate a state in which the upper limit of the rise from the reference surface 37*b* can be regulated. As described above referring to FIG. 5, the wire 23 generally includes the liner center conductor 25 and the insulation coating layer 26 covering the circumference of the center conductor 25. In this case, the diameter of the wire 23 refers to a diameter of the wire 23 at a part thereof covered by the cover section 40. In other words, the diameter of the wire 23 refers to a diameter of the center conductor 25 and the insulation coating layer 26 (D+2T) when the wire 23 includes the insulation coating layer 26 at the part covered by the cover section 40, or refers to the diameter of only the center conductor 25 (D) when the wire 23 does not include the insulation coating layer 26 at the part covered by the cover section 40.

In the above configuration, there may be a case in which, as illustrated in FIG. 2, the wire 23 makes contact with none of the cover section 40 and the reference surface 37*b*, and there may also be a case in which, although not illustrated, the wire 23 makes contact with the cover section 40 but does not make contact with the reference surface 37*b*.

Further, in the present embodiment, as clearly illustrated in FIG. 3, a projection 41 projecting in the same direction as the cover section 40, is provided on the connection section 37 of the terminal electrode 27. The projection 41 is configured to catch the wire 23 when the wire 23 being wound, thereby preventing the wire 23 from separating from the terminal electrode 27.

As clearly illustrated in FIGS. 2 and 3, it is preferable for the connection section 37 to be positioned at a predetermined distance from the collar section 4. To be more specific, it is preferable for the upright section 35 and the connection section 37 to be positioned at a predetermined distance from the vertical wall 38 and the bottom wall 39 regulating the recess 19, and to be not in contact with any of the vertical wall 38 and the bottom wall 39.

Reference signs 31, 32, 33, 34, 35, 36, 37, 37*a*, 37*b*, 40, and 43 respectively used for indicating the base section, first bend, mounting section, second bend, upright section, third bend, connection section, leading end portion, reference surface, cover section, projection, and weld lump in the first terminal electrode 27 will be also used, as needed, for respectively indicating a base section, first bend, mounting section, second bend, upright section, third bend, connection section, leading end portion, reference surface, cover section, projection, and weld lump in each of second, third, and fourth terminal electrodes 28, 29, and 30.

In general, winding processing in which the wires 23 and 24 are wound around the core section 2 is carried out before connection processing in which the wires 23 and 24 are connected to the terminal electrodes 27 to 30 is carried out. In the winding processing, while the drum-shaped core 3 being rotated about the center axis line of the core section 2, the wires 23 and 24 are supplied toward the core section 2 traversing from the nozzle. With this, the wires 23 and 24 are helically wound around the core section 2.

In the winding processing, in order to rotate the drum-shaped core 3 in the manner described above, the drum-shaped core 3 is held by a chuck connected to a rotational driving source. The chuck is so designed as to hold one of the collar sections of the drum-shaped core 3, for example, to hold the first collar section 4.

It is preferable for the number of winding turns of each of the first and second wires 23 and 24 around the core section 2 to be no more than about 42 turns. This is because the total length of the wires 23 and 24 can be shortened. By doing so, the Sdd11 characteristics can be made more preferable. In order to secure the inductance value, it is preferable for the number of winding turns of each of the wires 23 and 24 to be no less than about 39 turns.

Upon completion of the winding processing, the connection processing in which the wires 23 and 24 are connected to the terminal electrodes 27 to 30 is carried out as described below.

Hereinafter, as a typical example, processing in which the first wire 23 is connected to the first terminal electrode 27 will be described. FIG. 4 is a view corresponding to FIG. 2 and illustrating a state before welding.

At a stage in which the winding process described above has been completed, the end portion of the wire 23 is in a state of being extended onto the leading end portion 37*a* of the connection section 37 as illustrated in FIG. 4. Further, the end portion of the wire 23 is in a state where the insulation coating layer 26 is removed over the whole circumference thereof. A laser beam radiation technique, for example, is used for removing the insulation coating layer 26.

Next, a region where the center conductor 25 exposed from the insulation coating layer 26 of the wire 23 overlaps with the leading end portion 37*a* is radiated with a laser beam 42 for welding. With this, the center conductor 25 and the leading end portion 37*a* receiving the stated center conductor 25 are melted. At this time, the melted center conductor 25 and the leading end portion 37*a* take a ball-like shape due to surface tension applied thereto, thereby forming the weld lump 43. In other words, the weld lump 43 is formed by integrating the center conductor 25 and the terminal electrode 27 (the leading end portion 37*a*), and the center conductor 25 is put into the weld lump 43.

The center conductor 25 of the wire 23 tends to move in a direction toward the peak of the weld lump 43, in other words, the wire 23 tends to rise from the reference surface 37*b* of the connection section 37. In this case, the wire 23 is likely to be cut when an external force is applied to the wire 23. Alternatively, in a case where the common mode choke coil 1 is coated with a resin for moisture prevention, for example, the resin enters between the wire 23 and the reference surface 37*b* of the connection section 37 in the terminal electrode 27, whereby the wire 23 becomes likely to be cut when the stated resin repeats expansion and contraction.

However, in the present embodiment, because the upper limit of the rise of the wire 23 from the reference surface 37*b* of the connection section 37 in the terminal electrode 27 is regulated by the cover section 40, a state in which the wire 23 welded to the connection section 37 of the terminal electrode 27 is positioned along the reference surface 37*b* and in close proximity thereto can be maintained. This makes it possible to prevent the wire 23 from being cut and to realize high reliability with respect to the connection between the wire 23 and the connection section 37. Accordingly, the wire 23 can be made to be thinner, whereby the common mode choke coil 1 as a coil component can be miniaturized.

As discussed above, it is preferable that the connection section 37 be positioned at a predetermined distance from the collar section 4 so as not to make contact with the collar section 4. Although this configuration is not absolutely necessary, an increased temperature in the connection section 37 is unlikely to be transferred to the collar section 4 side with this configuration during the above-discussed welding processing, thereby making it possible to reduce an unfavorable influence of the heat on the drum-shaped core 3.

Figure 6:
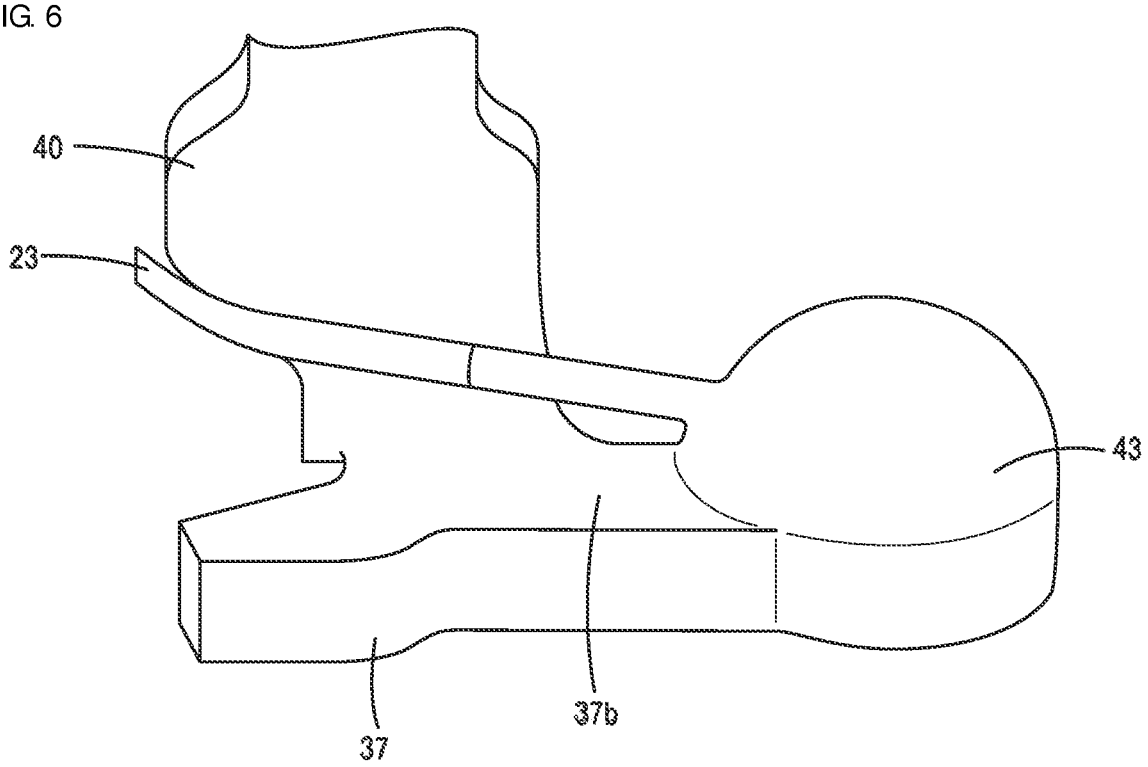
FIG. 6 is a view showing an electrically connected portion between the wire illustrated in FIG. 5 and a terminal electrode.

FIG. 6 shows an electrically connected portion between a wire and a terminal electrode of an actual product of a common mode choke coil. FIG. 6 is a view from a direction intermediate between a front direction illustrated in FIG. 2 and a bottom surface direction illustrated in FIG. 3. In FIG. 6, a substantially circular portion on the lower right corresponds to the weld lump 43. A state in which the wire 23 is extended from the weld lump 43 and the upper limit of the rise of the wire 23 from the reference surface 37*b* is regulated by the cover section 40, can be seen in FIG. 6.

Through the welding processing, not only the leading end portion 37*a* of the connection section 37 but also the remaining connection section 37 after the welding and the weld lump 43, are welded to each other and make contact with each other. The center conductor 25 of the wire 23 is included in the weld lump 43. In addition, because the insulation coating layer 26 is removed over the whole circumference in the end portion of the wire 23, the center conductor 25 of the wire 23 in the end portion thereof is also welded to the connection section 37 and the weld lump 43. Moreover, a material derived from the insulation coating layer 26 is not present inside the weld lump 43. In a case of distinguishing the connection section 37 from the weld lump 43, a portion whose outer edge shape remains plate-shaped can be taken as the connection section 37, and a portion whose outer edge shape is curved can be taken as the weld lump 43.

In this manner, strong welding is achieved. Further, since the center conductor 25 of the wire 23 is positioned between the connection section 37 and the weld lump 43, and the whole circumference thereof is incorporated in the weld lump 43, higher mechanical strength, lower electric resistance, higher stress resistance, higher chemical corrosion resistance, and the like can be obtained, so that higher reliability can be realized for the welding structure. In addition, since the material derived from the insulation coating layer 26 is not present inside the weld lump 43, blowholes at the time of melting can be decreased, whereby the welding structure with high reliability can be obtained from this point as well.

Thus far, the connection between the first terminal electrode 27 and the first wire 23 has been discussed. The same processing is carried out for the connections between the other terminal electrodes 28 to 30 and the wire 23 or 24, so that the same connection structure can be obtained.

As can be understood from FIG. 1, the first and fourth terminal electrodes 27 and 30 are respectively positioned on the opposite sides to extended portion sides of the first and second wires 23 and 24 from the core section 2, and the second and third terminal electrodes 28 and 29 are respectively positioned on the extended portion sides of the first and second wires 23 and 24 from the core section 2. Here, the "extended portion sides of the first and second wires 23 and 24 from the core section 2" refers to the sides where portions of the first and second wires 23 and 24 separating from the surface of the core section 2 are respectively positioned. In this case, the end portions of the first and second wires 23 and 24 respectively connected to the second and third terminal electrodes 28 and 29 can be positioned along the reference surface 37*b* of the connection section 37 and in close proximity thereto even if the cover section 40 is not present.

On the other hand, the end portions of the first and second wires 23 and 24 respectively connected to the first and fourth terminal electrodes 27 and 30 are likely to rise from the reference surface 37*b* of the connection section 37 if the cover section 40 is not present, which makes it difficult for the stated end portions to be positioned along the reference surface 37*b* and in close proximity thereto. Therefore, the cover section 40 is absolutely necessary for the first and fourth terminal electrodes 27 and 30.

As can be understood from the above discussion, it is sufficient for the cover section 40 to be provided at least in the first and fourth terminal electrodes 27 and 30. However, in a case where the winding direction of the wires 23 and 24 is reversed around the core section 2, for example, the extended portion sides of the wires 23 and 24 from the core section 2 are reversed as well, and as a result, the cover section 40 needs to be provided in the second and third terminal electrodes 28 and 29 in this case. In the present embodiment, in consideration of the above circumstances and the like, the cover section 40 is provided in all the terminal electrodes 27 to 30 in order to enhance versatility of the terminal electrodes 27 to 30.

Figure 7:
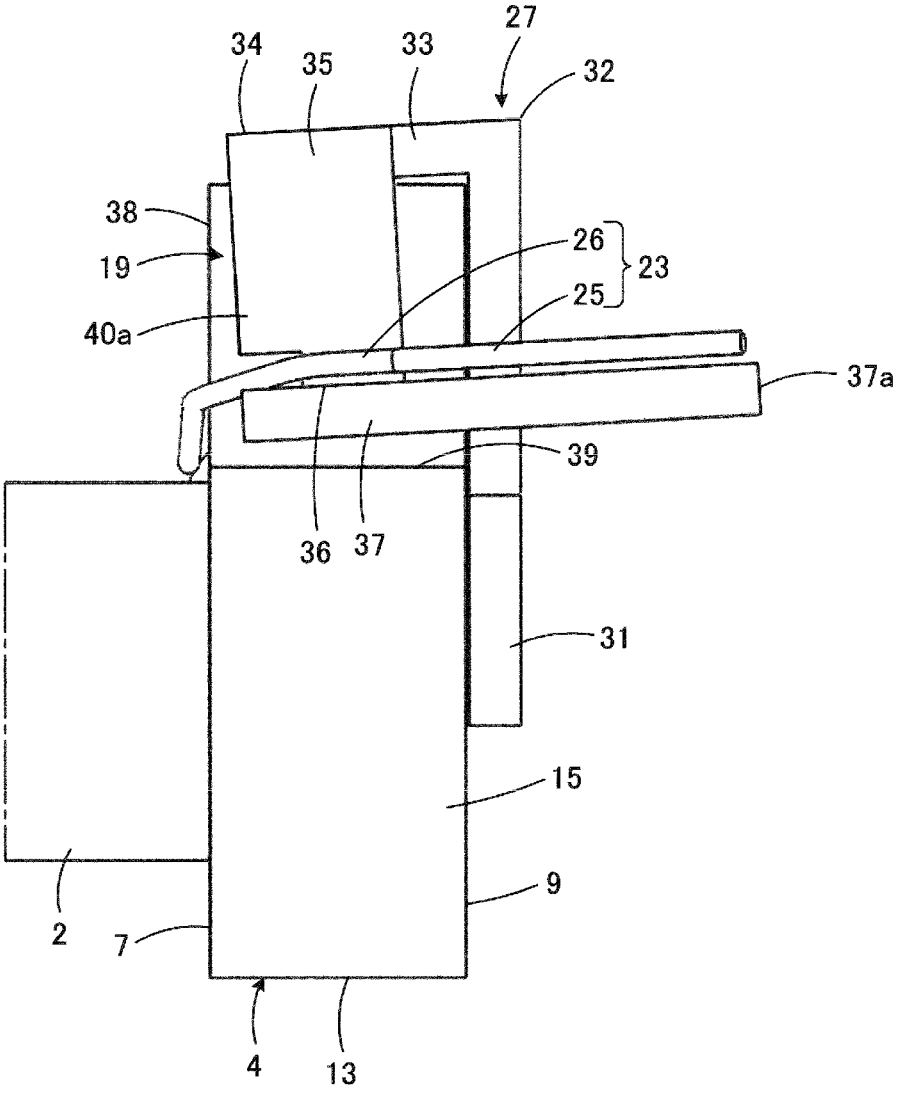
FIG. 7 is a view explaining a second embodiment of the present disclosure and corresponding to FIG. 4.
Figure 8:
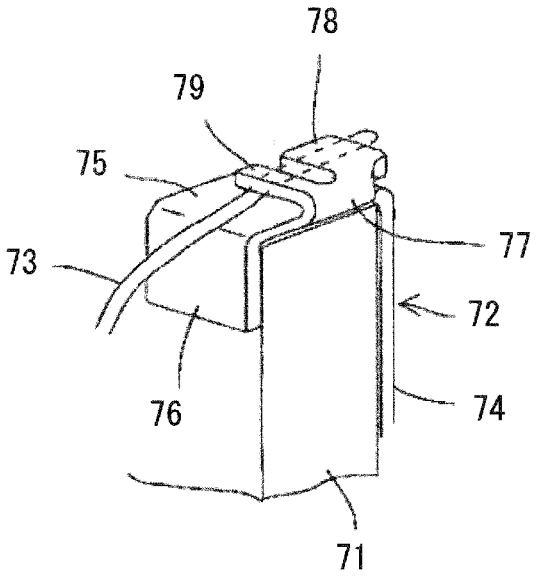
FIG. 8 is a perspective view illustrating one of collar sections which is part of a core provided in a coil component that is described in Japanese Patent No. 3909834, a terminal electrode disposed thereon, and an end portion of a wire to be connected to the terminal electrode, and also illustrating a state before welding.
Figure 9:
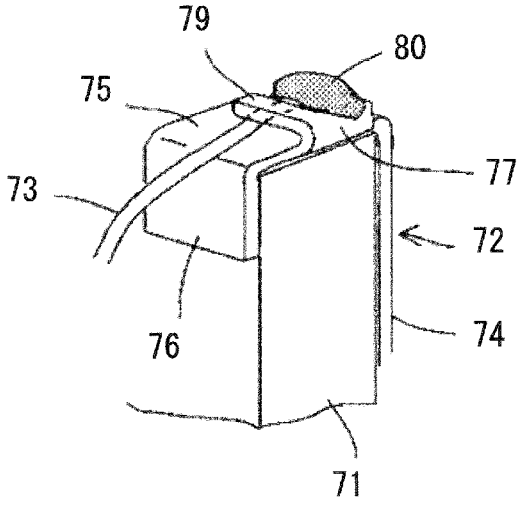
FIG. 9 is a view corresponding to FIG. 8 and illustrating a state after the welding.

FIG. 7 is a view explaining a second embodiment of the present disclosure and corresponding to FIG. 4. In FIG. 7, constituent elements equivalent to those illustrated in FIG. 4 are assigned the same reference signals and redundant description thereof is omitted.

A variation on the form of the cover section is illustrated in FIG. 7. A cover section 40*a* illustrated in FIG. 7 is provided on the upright section 35 in the terminal electrode 27. However, the cover section 40*a* is not formed in a projection-like shape, but is given by a lower edge of a wide-width portion provided in part of the upright section 35.

As can be understood from the above discussion, the cover section is not a target of the crimping processing in the terminal electrode, and can regulate the upper limit of the rise of the wire from the reference surface. Further, the cover section can be provided in any form as long as the stated cover section satisfies a condition that it is so positioned as to cover part of the wire when viewed in a direction perpendicular to the direction in which the reference surface extends. Accordingly, as another embodiment of the present disclosure, the cover section may not be part of the terminal electrode, but may be part of the core. Moreover, the cover section may be formed by attaching a material which is a different body from the terminal electrode or the core, such as an adhesive, to a specific section of the terminal electrode or the core.

Thus far, although the coil component according to the aspects of the present disclosure has been discussed based on the embodiments associated with the particularly specific common mode choke coil, the above-discussed embodiments are merely examples and various kinds of variations can be made. For example, the number of wires included in the coil component, the winding direction of the wire, the number of terminal electrodes, and the like can be changed in accordance with functions of the coil component.

Although, in the above embodiments, laser welding is used for connecting the terminal electrode and the wire, the welding is not limited to laser welding, and arc welding or the like may be used. Also, the coil component according to the embodiments of the present disclosure may not include a core.

While some embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

at least one wire; and at least one terminal electrode including a connection section to which an end portion of the wire is electrically connected, the connection section of the terminal electrode including a reference surface that extends along a direction, the end portion of the wire and the connection section of the terminal electrode being connected to each other via a weld lump rising from the reference surface, and the connection section of the terminal electrode including a projection, the projection projecting along a projection direction which is a same direction as the direction along which the reference surface extends and being configured to prevent the wire from separating from the terminal electrode in a direction that is along the reference surface and transverse to the projection direction.

2. The coil component according to claim 1, wherein the projection is located on an outside of the wire viewed in a direction perpendicular to the direction along which the reference surface extends.

3. The coil component according to claim 1, further comprising:

at least one cover section being positioned to cover at least part of the wire when viewed in a direction perpendicular to the direction along which the reference surface extends.

4. The coil component according to claim 3, wherein the cover section projects along the projection direction.

5. The coil component according to claim 1, further comprising:

a core including a core section around which the wire is helically wound, and first and second collar sections respectively provided on first and second end portions on the opposite sides to each other of the core section, and wherein the at least one the terminal electrode includes first and second terminal electrodes, the first terminal electrode being the terminal electrode including the connection section to which the end portion of the wire, which is a first end portion of the wire, is electrically connected, and the second terminal electrode including another connection section that is connected to a second end portion of the wire, and the first and second terminal electrodes are attached to the first and second collar sections, respectively.

6. The coil component according to claim 1, wherein the projection defines a space between an inner edge of the projection and another portion of the terminal through which a portion of the wire extends, such that the inner edge is configured to prevent the wire from separating from the terminal electrode.

7. The coil component according to claim 1, further comprising:

a collar section having a bottom surface, and wherein the at least one terminal electrode is disposed on the bottom surface of the collar section, and the projection is located above the bottom surface of the collar section.

8. A coil component comprising:

at least one wire; and at least one terminal electrode including a connection section to which an end portion of the wire is electrically connected, the connection section of the terminal electrode including a reference surface that extends along a direction, the end portion of the wire and the connection section of the terminal electrode being connected to each other via a weld lump rising from the reference surface, and the connection section of the terminal electrode including a projection, the projection projecting along a projection direction which is a same direction as the direction along which the reference surface extends and defining a space between an inner edge of the projection and another portion of the terminal through which a portion of the wire extends, such that the inner edge is configured to prevent the wire from separating from the terminal electrode.

9. The coil component according to claim 8, wherein the projection is located on an outside of the wire viewed in a direction perpendicular to the direction along which the reference surface extends.

10. The coil component according to claim 8, further comprising:

at least one cover section being positioned to cover at least part of the wire when viewed in a direction perpendicular to the direction along which the reference surface extends.

11. The coil component according to claim 10, wherein the cover section projects along the projection direction.

12. The coil component according to claim 8, further comprising:

a core including a core section around which the wire is helically wound, and first and second collar sections respectively provided on first and second end portions on the opposite sides to each other of the core section, and wherein the at least one the terminal electrode includes first and second terminal electrodes, the first terminal electrode being the terminal electrode including the connection section to which the end portion of the wire, which is a first end portion of the wire, is electrically connected, and the second terminal electrode including another connection section that is connected to a second end portion of the wire, and the first and second terminal electrodes are attached to the first and second collar sections, respectively.

13. The coil component according to claim 8, further comprising:

a collar section having a bottom surface, and wherein the least one terminal electrode is disposed on the bottom surface of the collar section, and the projection is located above the bottom surface of the collar section.

14. A coil component comprising:

a collar section having a bottom surface;

at least one wire; and at least one terminal electrode disposed on the bottom surface of the collar section, the at least one terminal electrode including a connection section to which an end portion of the wire is electrically connected, the connection section of the terminal electrode including a reference surface that extends along a direction, the end portion of the wire and the connection section of the terminal electrode being connected to each other via a weld lump rising from the reference surface, and the connection section of the terminal electrode including a projection, the projection projecting along a projection direction which is a same direction as the direction along which the reference surface extends, and the projection being located above the bottom surface of the collar section and being configured to prevent the wire from separating from the terminal electrode.

15. The coil component according to claim 14, wherein the projection is located on an outside of the wire viewed in a direction perpendicular to the direction along which the reference surface extends.

16. The coil component according to claim 14, further comprising:

at least one cover section being positioned to cover at least part of the wire when viewed in a direction perpendicular to the direction along which the reference surface extends.

17. The coil component according to claim 16, wherein the cover section projects along the projection direction.

18. The coil component according to claim 14, further comprising:

a core including a core section around which the wire is helically wound, and first and second collar sections respectively provided on first and second end portions on the opposite sides to each other of the core section, and wherein the at least one the terminal electrode includes first and second terminal electrodes, the first terminal electrode being the terminal electrode including the connection section to which the end portion of the wire, which is a first end portion of the wire, is electrically connected, and the second terminal electrode including another connection section that is connected to a second end portion of the wire, and the first and second terminal electrodes are attached to the first and second collar sections, respectively.

* * * * *